US006722733B2

(12) United States Patent
Schmidt et al.

(10) Patent No.: US 6,722,733 B2
(45) Date of Patent: Apr. 20, 2004

(54) PROTECTIVE SEAT COVER

(75) Inventors: William Schmidt, Newport, MI (US); Herbert Reynolds, Ocean Isle Beach, NC (US)

(73) Assignee: Mirror Lite, Rockwood, MI (US)

( * ) Notice: Subject to any disclaimer, the term of this patent is extended or adjusted under 35 U.S.C. 154(b) by 0 days.

(21) Appl. No.: 10/191,374

(22) Filed: Jul. 8, 2002

(65) Prior Publication Data

US 2004/0004388 A1 Jan. 8, 2004

(51) Int. Cl.[7] ..... A47C 31/00
(52) U.S. Cl. ..... 297/229; 297/482
(58) Field of Search ..... 297/482, 225, 297/229, 219.1, 228

(56) References Cited

U.S. PATENT DOCUMENTS 4,759,588 A * 7/1988 Husnik ..... 297/482 X
4,891,454 A * 1/1990 Perdelwitz et al. ..... 297/229 X
5,158,339 A * 10/1992 Miyanaga ..... 297/482 X
6,309,017 B1 * 10/2001 Middleton ..... 297/219.1 X
6,322,141 B1 * 11/2001 Dutkievic et al. ..... 297/218.1
6,416,128 B1 * 7/2002 Fujii ..... 297/218.1

* cited by examiner

*Primary Examiner*—Anthony D. Barfield
(74) *Attorney, Agent, or Firm*—John A. Artz; Artz & Artz, P.C.

(57) ABSTRACT

Protective seat cover members for vehicles, particularly for rear seat members of automobiles. Sleeve members affixed to the seat cover members fit over and protect the seat belt members. The seat cover members are impervious to liquids and adapted to be easily attached and removed from the seat members and disposed of when necessary.

26 Claims, 2 Drawing Sheets

PROTECTIVE SEAT COVER

TECHNICAL FIELD

The present invention relates to seat covers for vehicles, and more particularly to protective seat covers for use particularly in the rear seats of automobiles.

BACKGROUND OF THE INVENTION

The interiors of vehicles, particularly automobiles, are often difficult to clean, particularly when the item that was spilled or dispersed is liquid. The situation is more severe when the liquid is a toxic or biohazardous liquid or one which should be handled with care and properly disposed of. For example, vehicles of police forces and other custodial-type departments often transport persons who are injured, sick, or otherwise not operating under normal circumstances. These individuals can often soil the vehicles with various bodily fluids, such as blood, urine, vomit, etc. For example, the individual could be sick from too much alcohol, have a drug condition, or be bleeding from an accident or injury.

With the risk of diseases known today, it is often necessary to thoroughly clean and sterilize the interiors of vehicles, such as the rear seats of police vehicles, after transport of such persons. This cleaning can often take a vehicle out of service for a day or more.

SUMMARY OF THE INVENTION

It is an object of the present invention to provide a protective cover for portions of the interior of automobiles and other vehicles. It is another object of the present invention to provide a protective seat cover for the rear seats of automobiles.

It is a further object of the present invention to provide a disposable seat cover for vehicle seat members which can be easily removed and disposed of after being used or soiled.

These and other objects are met with the present invention which also overcomes the problems specified above. The present invention provides a seat cover member, particularly adapted for the rear seats of vehicles, such as automobiles. The seat cover member is disposable and made from a liquid impervious material. The seat cover is preferably sized to generically fit all rear seat members of automobiles.

Elastic portions and Velcro-type attachment members are provided on the seat cover member so that it can be quickly and easily attached and removed from the seat member. In addition, one or more tubular members are provided in the seat cover member in order to facilitate passage of seat belts and at the same time prevent liquids and other materials from passing through openings in the seat cover member and soiling the seat member.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
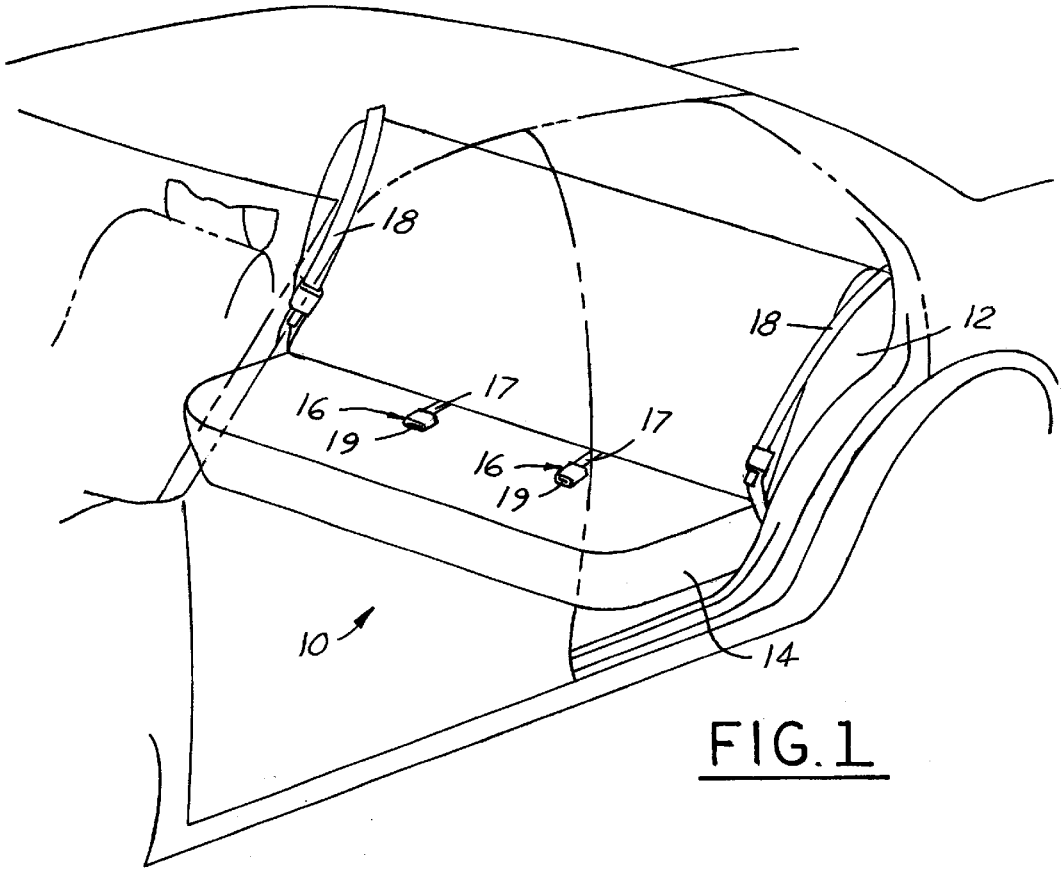
FIG. 1 generally illustrates a rear seat for an automobile or other vehicle.
Figure 2:
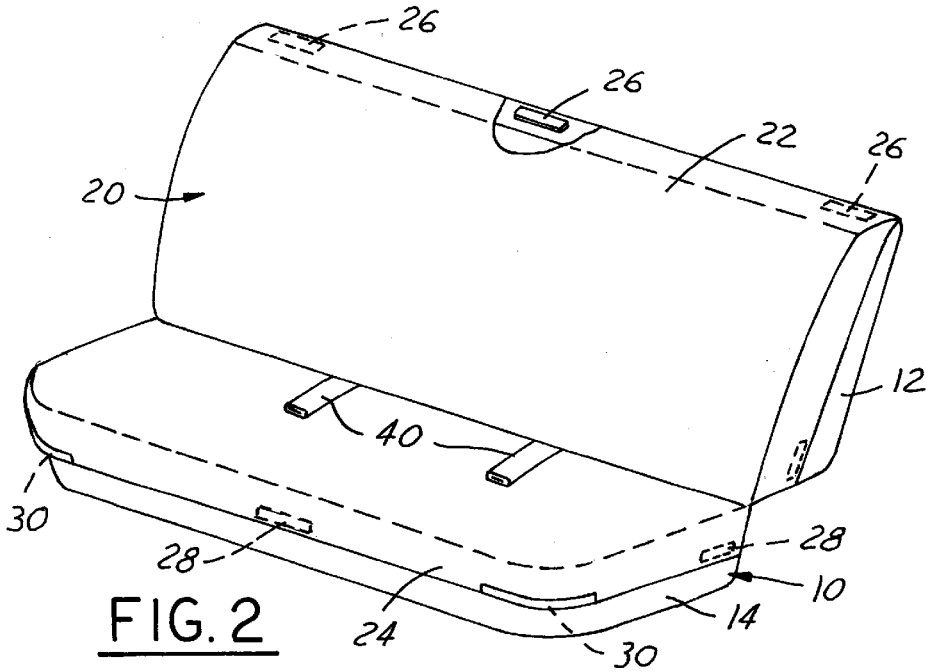
FIG. 2 illustrates a protective seat cover member in accordance with the present invention installed on a seat member.

FIGS. 1 and 2 illustrate use of the present invention with FIG. 1 generally depicting a rear seat member of a passenger vehicle, such as an automobile, and FIG. 2 illustrates that seat member with the inventive protective seat cover member positioned thereon. The seat member is referred to generally by the reference numeral 10 in the drawings, and the protective seat cover member is referred to generally by the reference numeral 20.

As shown in FIGS. 1 and 2, the vehicle seat member 10 has an upper or back portion 12 and a lower or seat portion 14. In addition, as is common in all vehicles today, seat belt mechanisms 16 are provided with the seat member and adapted to be buckled around the occupants and hold them securely in place. The seat belt mechanisms generally include a pair of lap belt portions 17, a shoulder portion 18, and a buckle member 19.

Even though the seat member 10 illustrated in the drawings utilizes a bench-type seat member 14 and single upper or back member 12, it is to be understood that the member 10 illustrated is only representative of all vehicle seat members. Thus, individual seat members with individual lower members and/or individual upper or rear members can be utilized with the present invention. Also, although the drawings illustrate a pair of seat belt mechanisms 16, it is to be understood that any number of seat belt mechanisms can be utilized on a vehicle seat member in accordance with the present invention. It is also to be understood that the present invention can be used with front, rear or even third-seat members and is not restricted for use only with rear seat members. In this regard, it is common to include two or three seat belt mechanisms with the seat members of most vehicles today.

The protective seat cover member 20 has a main body member made from a single piece of material. This avoids seams or other openings which could allow fluids or other materials to leak or pass therethrough and soil or contaminate the seat member 10. As shown in FIG. 2, the seat cover member 20 includes an upper or back portion 22 and a lower or seat portion 24. Each of the portions 22 and 24 have one or more attachment mechanisms thereon in order to be secured to the back seat member. For example, the upper portion 22 includes a plurality of hook or loop fastening strips 26, e.g. VELCRO attachment strips, which mate with corresponding loop or hook fastening strips (not shown) installed on the upper seat member 12. In addition, the seat portion 24 of the seat cover member 20 includes a plurality of hook or loop fastening strips 28 which are used to secure the lower portion 24 to the lower or seat member 14 of the vehicle seat member.

In addition, elastic members 30 are secured or sewn in the corners of the seat cover member 20 in order for the cover member 20 to firmly and securely hold the lower portion 24 on the seat member 10.

Figure 3:
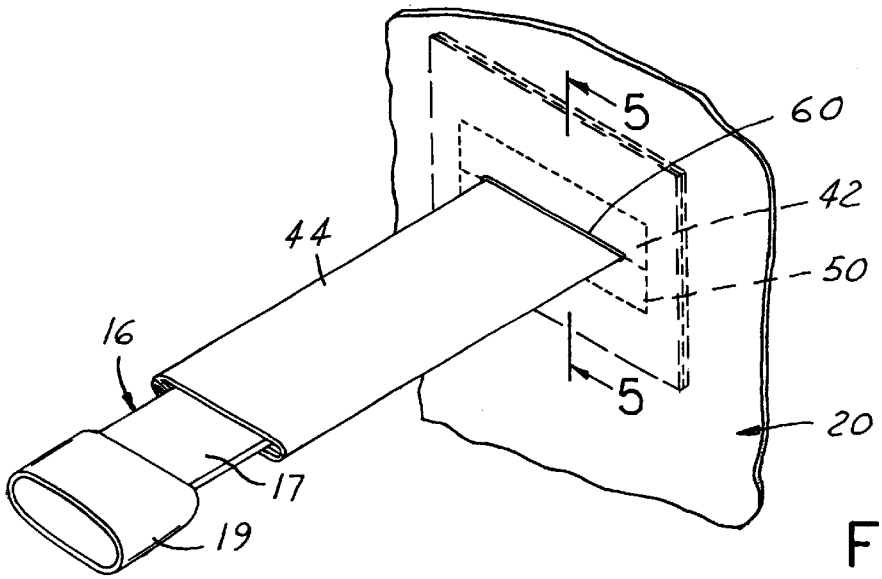
FIG. 3 is a close up view of a sleeve member in accordance with the present invention with a portion of a sat belt positioned in it.
Figure 4:
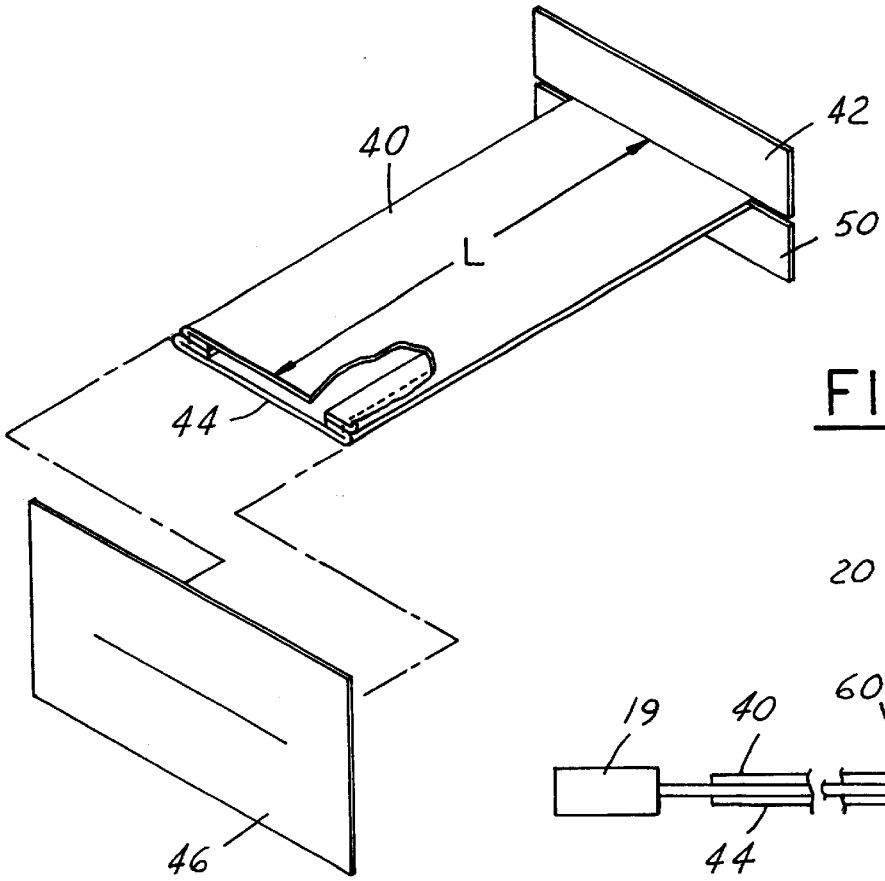
FIGS. 4 and 5 illustrate an individual representative sleeve member which can be used with the present invention, with FIG. 5 being a cross-sectional view taken along line 5—5 in FIG. 3.
Figure 5:
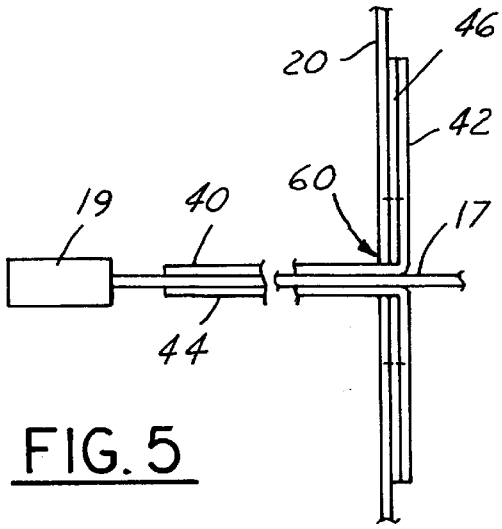

Also in accordance with the present invention, one or more sleeve members 40 are provided on the protective seat cover member 20. One of the sleeve members 40 is shown in FIG. 4, and an enlarged depiction of one of the sleeve members 40 attached to the seat cover member 20 is shown in FIGS. 3 and 5. The sleeve member 40 generally comprises an attachment portion 42 and a tubular member 44.

The seat cover member can be made of any liquid impervious material, but preferably is made from TYVEK®comma a spunbonded olefin material, produced by DUPONT.

The sleeve members 40 are preferably made of the same material as the seat cover members. The material for the sleeve members also should have the same characteristics and specifications as the material for the seat cover member in order to prevent leakage or passage of fluids and other matters through the cover and onto the seat member. The sleeve members 40 are securely affixed to the seat cover member 20 for the same reason. For example, the sleeve members 40 can be passed or positioned through slots or slits 60 in the seat cover member 20 and then sewn or stitched securely in place by stitches 50 (as shown in FIG. 3). Other sleeve mechanisms or fastening means could also be used to secure, affix and attach the sleeve members to the seat cover members. It is important that the seat belt sleeve members be secured to the seat cover in such a manner to provide a liquid-tight seam or joint in order to prevent passage of liquids and contaminants through the seat member. The sleeve members can either be positioned on the front or exposed side of the cover member, or on the back or unexposed side and protrude through the seat belt slits, as shown in FIGS. 3 and 5.

The same number of sleeve members 40 are provided for the seat cover member as the number of seat belts and/or seat belt mechanisms supplied with the vehicle for the seat member being protected. In this regard, FIGS. 1–2 illustrate two seat belt mechanisms 16 and two corresponding sleeve members 40, but this is only representative for illustration purposes and is not meant to be limiting as to the invention. For example, one, two, three, four or more sleeve members could be provided on the seat cover member 20.

The seat belt members 17 and buckle members 19 fit through the center of the sleeve members 40, as shown in FIGS. 3 and 5. The seat belts are positioned through the sleeve members when the seat cover member is installed on the seat member in the vehicle. The sleeve members are preferably several inches long in length L, such as 4–12 inches. Of course, it is to be understood that the sleeve members can be of any length sufficient to fulfill the purposes of the present invention. The sleeve members prevent liquids and other matter which might be spilled or deposited on the seat cover member for passing through the seat cover member and soiling the seat member. The sleeve members also protect the seat belt members 17—most of which are made from cloth-type materials—from becoming soiled.

The seat cover members are preferably disposable. For example, if anything becomes spilled or deposited thereon and needs to be disposed of, the seat cover member can be detached at its upper, lower and outer edges from the seat member and easily rolled or balled up. This captures the undesirable matter in the center of the package and allows the seat cover member and matter to be easily, cleanly and properly disposed of. In this regard, a "bio-bag" can be provided or utilized with each of the seat cover members for ease of disposal when necessary.

The seat cover member also can be attached to the seat member in any conventional manner, such as snaps, buttons, pins, elastic members, string, turn buckles and the like—although it is preferred that the attachment mechanisms not provide openings through the seat cover member in which liquids and other substances could pass through. It is also preferred, but not mandatory that the seat cover member completely cover the rear and seat portions of the seat member.

It is also significant that the seat cover member be made of a single one-piece of material so that contaminants cannot pass through any cracks or joints and soil or contaminate any of the seat members. A one-piece cover member also prevents custodial-type passengers from hiding illegal substances in-between seat members or in seams or joints in seat members.

Although the present invention is indicated as having particular use for police and other custodial vehicles, the protective seat cover can be used in any vehicle regardless of what it is used for or what it transports. For example, the present invention can be used in buses, vans and other vehicles which are used to transport handicap individuals or children with special needs.

While particular embodiments of the invention have been shown and described, numerous variations and alternative embodiments will occur to those skilled in the art. Accordingly, it is intended that the invention be limited only in terms of the appended claims.

What is claimed is:

1. A protective seat cover member for a vehicle seat member comprising:

a one-piece body member having a first portion for placement on and protection of the rear portion of a vehicle seat member and a second portion for placement on and protection of the seat portion of a vehicle seat member, said body member being made from a liquid impervious material and having at least one opening therein, and at least one sleeve member secured to said body member for passage therethrough and protection of a seat belt member, said sleeve member being positioned adjacent said at least one opening.

2. The protective seat cover member as set forth in claim 1 further comprising attachment members for attaching said body member to a vehicle seat member.

3. The protective seat cover member as set forth in claim 2 wherein said attachment members are selected from the group consisting of hook and loop fasteners, snaps, buttons, pins, elastic members, string, turn buckles, and combinations thereof.

4. The protective seat cover member as set forth in claim 1 wherein at least two sleeve members are provided, each sleeve member being secured to said body member.

5. The protective seat cover member as set forth in claim 1 wherein said sleeve member has an attachment portion and a tubular portion.

6. The protective seat cover member as set forth in claim 5 wherein said attachment portion is affixed to said body portion and said tubular portion extends through said opening.

7. The protective seat cover member as set forth in claim 5 wherein said attachment portion is sewn to said body portion.

8. The protective seat cover member as set forth in claim 1 wherein said body member and said sleeve member are made from the same material.

9. The protective seat cover member as set forth in claim 1 wherein said body member is made of a spunbonded olefin material.

10. The protective seat cover member as set forth in claim 1 wherein said body member and said sleeve member are each made of a spunbonded olefin material.

11. A method for installing a protective seat cover member on a vehicle seat member with at least one seat belt member thereon, said material method comprising the steps of:

(a) providing a protective seat cover comprising:

a one-piece body member having a first portion for placement on and protection of the rear portion of a vehicle seat member and a second portion for placement on and protection of the seat portion of a vehicle seat member, said body member being made from a liquid impervious material and having at least one opening therein, p2 least one sleeve member secured to said body member for passage therethrough and protection of a seat belt member, said sleeve member being position in at least said one opening, (b) positioning said protective seat cover member on a vehicle seat member, and (c) passing said seat belt member through said sleeve member.

12. The method as set forth in claim 11 wherein said seat member has a plurality of seat members thereon and wherein said protective seat cover member has a corresponding plurality of sleeve members thereon, and wherein said method further comprises the step of passing each of the seat belt members through a respective one of said sleeve members.

13. A protective seat cover member for a vehicle seat member comprising:

a one-piece body member having a first portion for placement on and protection of the rear portion of a vehicle seat member and a second portion for placement on and protection of the seat portion a vehicle seat member, said body member being made from a liquid impervious material and having at least one opening therein, and at least one sleeve member secured to said body member for passage therethrough and protection of a seat belt member, said sleeve member being positioned adjacent to said at least one opening, said sleeve member having an attachment portion that is sewn to said body member and a tubular portion that extends through said opening.

14. The protective seat cover member as set forth in claim 13 further comprising attachment members for attaching said body member to a vehicle seat member.

15. The protective seat cover member as set forth in claim 14 wherein said attachment members are selected from the group consisting of hook and loop fasteners, snaps, buttons, pins, elastic members, string, turn buckles, and combinations thereof.

16. The protective seat cover member as set forth in claim 13 wherein at least two sleeve members are provided, each sleeve member being secured to said body member.

17. The protective seat cover member as set forth in claim 13 wherein said body member and said sleeve member are made from the same material.

18. The protective seat cover member as set forth in claim 13 wherein said body member is made of a spunbonded olefin material.

19. The protective seat cover member as set forth in claim 13 wherein said body member and said sleeve member are each made of a spunbonded olefin material.

20. A protective seat cover member for a vehicle seat member comprising:

a one-piece body member having a first portion for placement on and protection of the rear portion of a vehicle seat member and a second portion for placement on and protection of the seat portion a vehicle seat member, said body member being made from a liquid impervious material and having at least one opening therein, and at least one sleeve member secured to said body member for passage therethrough and protection of a seat belt member, said sleeve member being positioned adjacent to said at least one opening, said sleeve member having an attachment portion that is affixed to said body member and a tubular portion that extends through said opening.

21. The protective seat cover member as set forth in claim 20 further comprising attachment members for attaching said body member to a vehicle seat member.

22. The protective seat cover member as set forth in claim 21 wherein said attachment members are selected from the group consisting of hook and loop fasteners, snaps, buttons, pins, elastic members, string, turn buckles, and combinations thereof.

23. The protective seat cover member as set forth in claim 20 wherein at least two sleeve members are provided, each sleeve member being secured to said body member.

24. The protective seat cover member as set forth in claim 20 wherein said body member and said sleeve member are made from the same material.

25. The protective seat cover member as set forth in claim 20 wherein said body member is made of a spunbonded olefin material.

26. The protective seat cover member as set forth in claim 20 wherein said body member and said sleeve member are each made of a spunbonded olefin material.

* * * * *